US006499218B2

(12) United States Patent
Rocha

(10) Patent No.: US 6,499,218 B2
(45) **Date of Patent: *Dec. 31, 2002**

(54) FOUR SIDED DUAL BLADE SHAVER

(76) Inventor: Manual Antonio Rocha, Rua dos Ferreiros, 181 SE., 9000 Funchal, Madeira Island (PT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/221,444

(22) Filed: Dec. 28, 1998

(65) Prior Publication Data

US 2001/0003869 A1 Jun. 21, 2001

(51) Int. Cl.[7] ..... B26B 21/20; B26B 21/22; B26B 21/44

(52) U.S. Cl. ..... 30/41; 30/41.5; 30/49; 30/50; 30/346.57; 30/526; 30/535

(58) Field of Search ..... 30/41, 41.5, 346.57, 30/346.58, 346.59, 535, 32, 47, 48, 49, 50, 84, 346.61, 526; D28/46

(56) References Cited

U.S. PATENT DOCUMENTS

| | | | | | |
|---|---|---|---|---|---|
| 1,069,831 | A | * | 8/1913 | Traylor | 30/346.57 |
| 1,556,269 | A | * | 10/1925 | Warming | 30/41 |
| 1,821,825 | A | * | 9/1931 | Zumwalt | 30/49 |
| 1,852,708 | A | * | 4/1932 | Stuart | 30/41 |
| 1,923,439 | A | * | 8/1933 | Hukill | 30/50 |
| 1,991,405 | A | * | 2/1935 | Merriman | 30/41 |
| 2,392,975 | A | * | 1/1946 | Cooney | 30/41 |
| 4,534,110 | A | | 8/1985 | Glass | 30/346.57 |
| 4,809,432 | A | * | 3/1989 | Schauble | 30/41 |
| 5,241,751 | A | * | 9/1993 | Goh | 30/41.5 |
| 5,287,624 | A | | 2/1994 | Mondo et al. | 30/41 |
| 5,343,622 | A | | 9/1994 | Andrews | 30/50 |
| 5,384,961 | A | * | 1/1995 | Gregory | 30/41.5 |
| 5,537,749 | A | | 7/1996 | Cacioppo | 30/41.5 |
| 5,673,485 | A | * | 10/1997 | Hill | 30/41.5 |

* cited by examiner

*Primary Examiner*—Clark F. Dexter
(74) *Attorney, Agent, or Firm*—Michael I Kroll

(57) ABSTRACT

A safety razor having a shaving head which includes dual blades with multiple shaving edges having different lengths and/or shapes to provide a selection of shaving edges for various types of hair encountered on the body of a user. Each blade has straight and convex shaving edges on two sides thereof as well as blade extensions having shorter straight and convex shaving edges on two ends thereof. The razor further includes a handle with a conduit located therein in communication with the shaving head whereby water can travel through the handle, into the shaving head and past the blades to dislodge debris. Further, the safety razor is equipped with a slidable plunger which is slidable in the conduit so that oils, creams or liquids can be applied through the shaving head.

5 Claims, 11 Drawing Sheets

FOUR SIDED DUAL BLADE SHAVER

BACKGROUND OF THE INVENTION

1. Field of the Invention

The present invention relates generally to safety razors and, more specifically, to a safety razor with a detachable and replaceable shaving head having dual blades which project from four sides providing four varied blade types for selectively shaving different body areas and said safety razor having an elongated handle wherein said handle has a channel located down the center of the handle with an opening at the base of said handle and an opening into the blade cavity whereby water will travel from the opening in the end of the handle to the shaving head where it will dislodge shaving debris from around the blades.

Another embodiment provides for a disposable safety razor having a fixed head as the preferred embodiment and having all other characteristics as the preferred embodiment.

An additional embodiment is provided having dual blades with one straight edge shaving surface and an oppositely opposed convex edge shaving surface and having an elongated handle wherein said handle has a channel located down the center of the handle with an opening at the base of said handle and an opening into the blade cavity whereby water will travel from the opening in the end of the handle to the shaving head where it will dislodge shaving debris from around the blades.

2. Description of the Prior Art

There are other safety razors designed with angular blades with more than one shaving surface. Typical of these is U.S. Pat. No. 4,534,110 issued to Glass on Aug. 13, 1985.

Another patent was issued to Mondo et al. on Feb. 22, 1994 as U.S. Pat. No. 5,287,624. Yet another U.S. Pat. No. 5,343,622 was issued to Andrews on Sep. 6, 1994 and still yet another was issued on Jul. 23, 1996 to Cacioppo as U.S. Pat. No. 5,537,749.

U.S. Pat. No. 4,534,110

Invention: Henry P. Glass

Issued: Aug. 13, 1985

A triple-edge safety razor in which no portion thereof are disconnected during use. The razor employs a novel blade assembly wherein three individual strip blades are interconnected by a flexible central web affording hinged connection therebetween. A number of methods of manufacture of the blade assembly are described.

U.S. Pat. No. 5,287,624

Inventor: Luciano G. Mondo et al.

Issued: Feb. 22, 1994

An improved disposable safety razor is provided which consists of an elongated handle with a head having a convex top surface and a flat bottom surface attached to an upper end of the elongated handle. A pair of single cutting edge razor blades are clamped parallel within the head with the cutting edges angled outwardly and upwardly in opposite directions from the convex top surface of the head, so as to be useful in shaving in both forward and rearward strokes.

U.S. Pat. No. 5,343,622

Inventor: Edward A. Andrews

Issued: Sep. 6, 1994

A bi-directional razor device is formed of a narrow, elongated head and a transversely extending, internal hand grip formed of molded plastic material. Two pair of narrow, strip like razor blades are embedded in the head, with one pair extending in one direction and the other pair extending in an opposite direction at an acute angle relative to the first pair. The blades extend along the length of the head. Thus, the user may move the razor head in one direction for contacting one pair of blades against the users skin for cutting hair and then move the handle in the opposite direction while the blades remain engaged upon the skin for cutting hair in both directions.

U.S. Pat. No. 5,537,749

Inventor: Tony Cacioppo

Issued: Jul. 23, 1996

A razor including a shaving head with at least one blade attached to the shaving head which has an exposed shaving edge extending longitudinally on the having head for use in shaving. A passage is provided in the shaving head which extends from one end of the shaving head to the opposite end. Water for cleaning of the blades can be applied to an inlet under a running water faucet. A first outlet for discharging water from the passage is provided and is located adjacent to the shaving edge of the blade to clear shaving debris from the blade. The passage also includes a second outlet at the opposite end of the shaving head from the inlet. The second outlet has dimensions less than the dimensions of the inlet so that the volume of water passing through the inlet is greater than the volume of water passing through the second outlet. The difference in size between the inlet of the passage and the second outlet causes the fluidic pressure of the rinsing water to increase as the water travels from the inlet towards the second outlet. The increasing pressure of the rinsing water causes the water to flow through the first outlet with greater force, while still allowing a portion of the rinsing water to flow out of the second outlet.

While these safety razors may be suitable for the purposes for which they were designed, they would not be as suitable for the purposes of the present invention, as hereinafter described.

SUMMARY OF THE PRESENT INVENTION

The present invention discloses a safety razor having dual blades with multiple shaving surfaces having different blade lengths and/or blade shapes to provide a selection of shaving surfaces for the various types of hair encountered on one's body. The present invention includes longer blades being both straight and convex. The present invention includes blades on the edges of its head which are both straight and convex and smaller in length for trimming close areas of the body. The handle of the razor has a conduit located therein and traveling throughout the length of the handle connecting to the blade cavity whereby water can travel through the handle to the shaving heads and in and around the shaving heads so that it will dislodge shaving debris from around the blades. Furthermore, the present invention is equipped with a slidable plunger which travels in the handle cavity so that oils, creams or liquids can be applied through the razor by pressing on the plunger as one shaves. Embodiments are disclosed for razors with a removable head, a single piece disposable razor, and a razor with only two straight blades.

A primary object of the present invention is to provide a safety razor with dual blades having multiple shaving surfaces.

Another object of the present invention is to provide a safety razor having different blade lengths and/or blade edges to provide a selection of shaving blades for different types of hair removal.

Yet another object of the present invention is to provide a safety razor having an elongated handle wherein a channel is located within the center of the handle having an opening at one distal end and another opening leading into the blade cavity whereby water can travel from the opening in the end of the handle to the shaving head where it will dislodge shaving debris from around the blades.

Still yet another object of the present invention is to provide a safety razor having a plunger which can be inserted within the handle cavity whereby a number of oils, creams and liquids can be stored and selectively ejected during shaving.

Another object of the present invention is to provide a safety razor with a removable disposable and replacable shaving head.

Yet another object of the present invention is to provide an additional embodiment of the present invention whereby the shaving head is not removable thereby providing a disposable safety razor.

Still yet another object of the present invention is to provide another additional embodiment of the present invention whereby the shaving head is not removable and the dual blades have two shaving surfaces wherein one edge is a straight edge and the oppositely opposed edge is convex.

Additional objects of the present invention will appear as the description proceeds.

The present invention overcomes the shortcomings of the prior art by providing a safety razor having dual blades with multiple shaving surfaces having different blade lengths and/or blade edges to provide a selection of shaving blades for varying types of hair removal and an elongated handle having a channel located within the center of the handle with an opening at one distal end and another opening leading into the blade cavity whereby water can travel from the opening in the end of the handle to the shaving head where it will dislodge shaving debris from around the blades and furthermore using a slideable plunger within the handle cavity a number of oils, creams and liquids can be applied while shaving.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENTS

Figure 1:
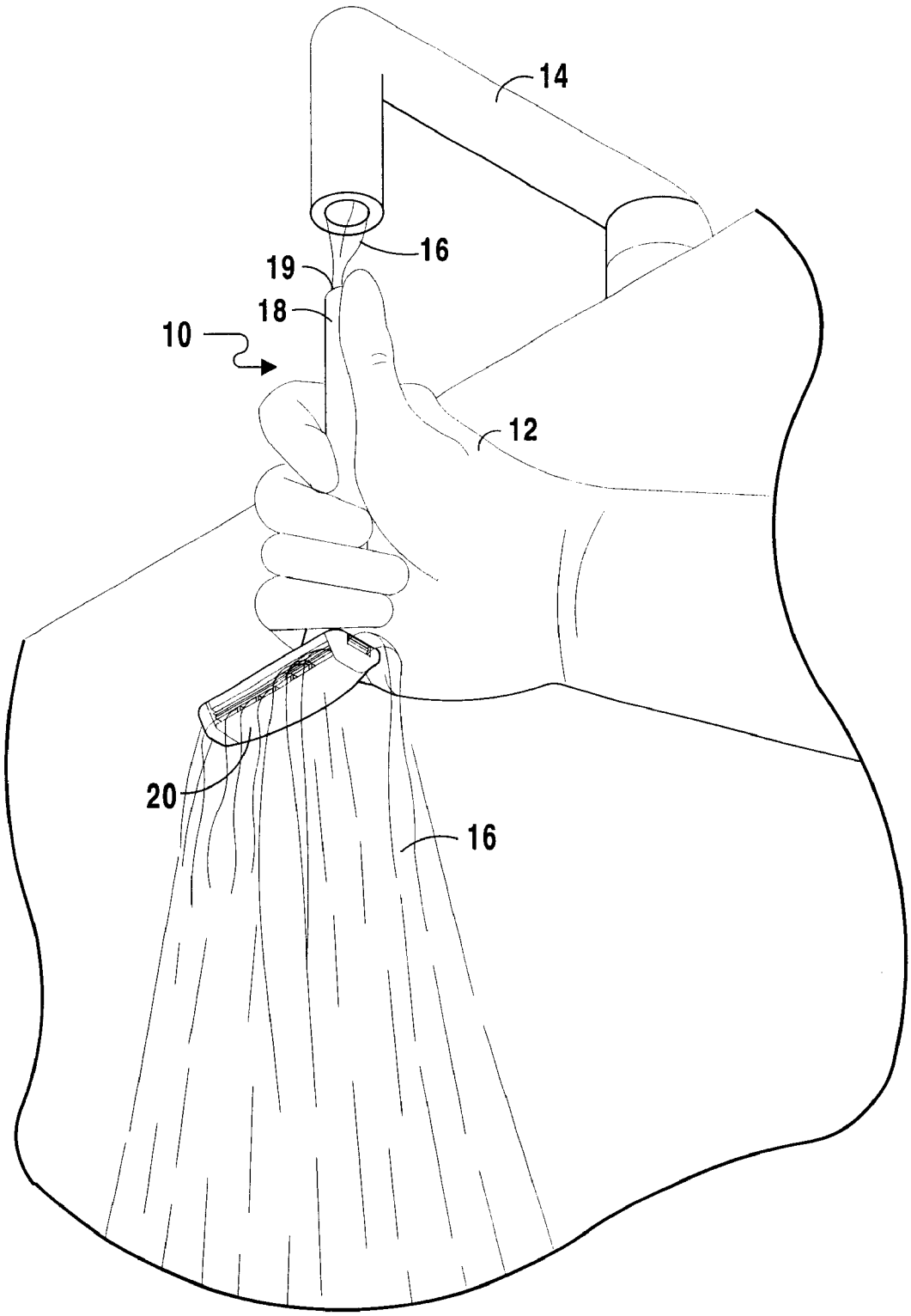
FIG. 1 is a perspective view of the preferred embodiment of the present invention being cleaned by placing the safety razor with the opening of the channel located at the base of the handle under running tap water through which the water will travel to the head of the razor and force the shaving debris from all cutting surfaces.

Turning now descriptively to the drawings, in which similar reference characters denote similar elements throughout the several views, FIGS. 1 through 11 illustrate the present invention being a razor with multiple style blades. With regard to the reference numerals used, the following numbering is used throughout the various figures.

Turning to FIG. 1, therein is shown a perspective view of the preferred embodiment of the present invention 10 in the hand 12 of a user being cleaned by placing the safety razor 10 with the opening 19 of the conduit of the handle 18 located at the base of the handle 18 under running tap water 16 furnished by a water faucet 14. As can be seen, the tap water 16 runs through the handle 18 and travels to the head of the razor 20 thereby forcing shaving debris from all cutting surfaces.

Figure 2:
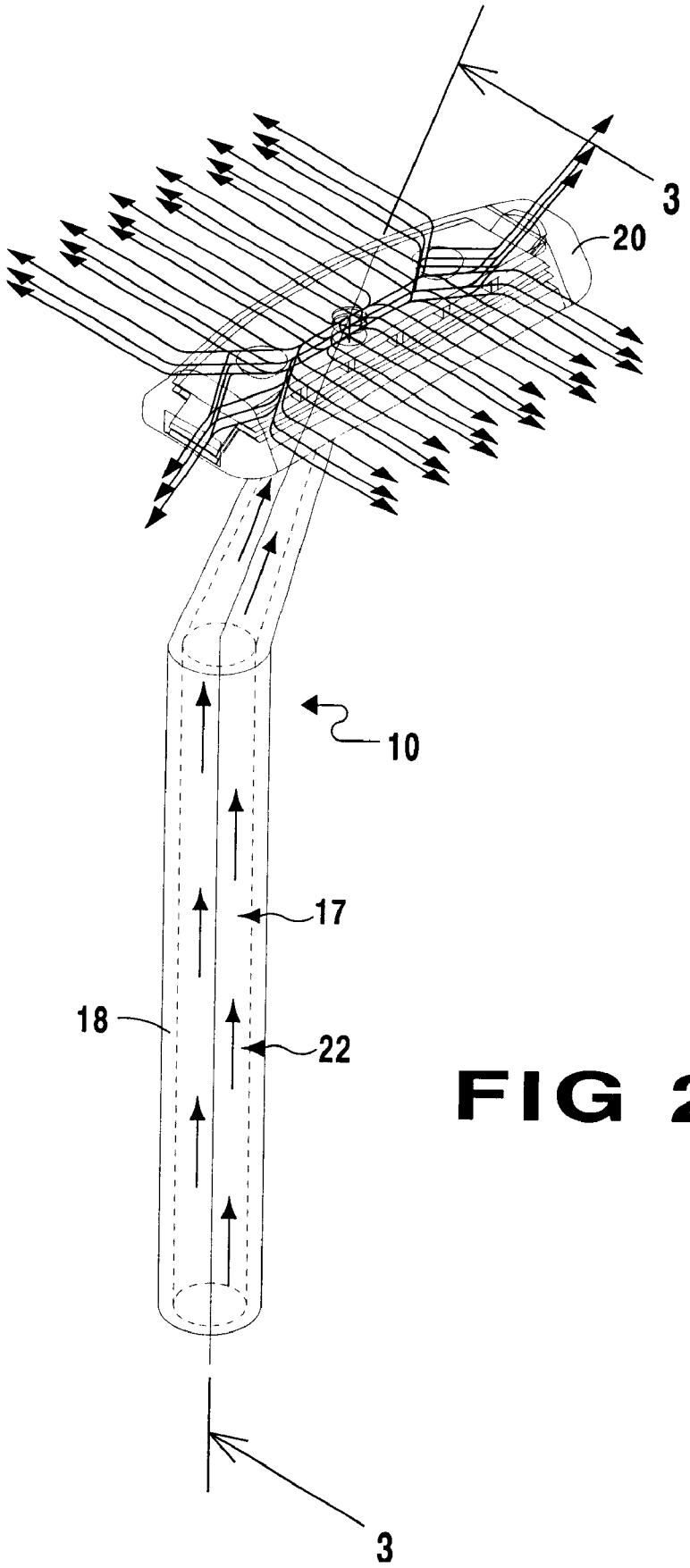
FIG. 2 is an enlarged view of the safety razor showing by arrows the path of the water as it travels from the channel opening located on the end of the handle through the head of the safety razor and around all blade surfaces.

Turning to FIG. 2, therein is shown an enlarged view of the safety razor 10 showing with arrows 22 the path the water travels through the conduit 17 located in the handle 18 through the head 20 of the safety razor and around all the blade surfaces thereby cleaning the razor 10.

Figure 3:
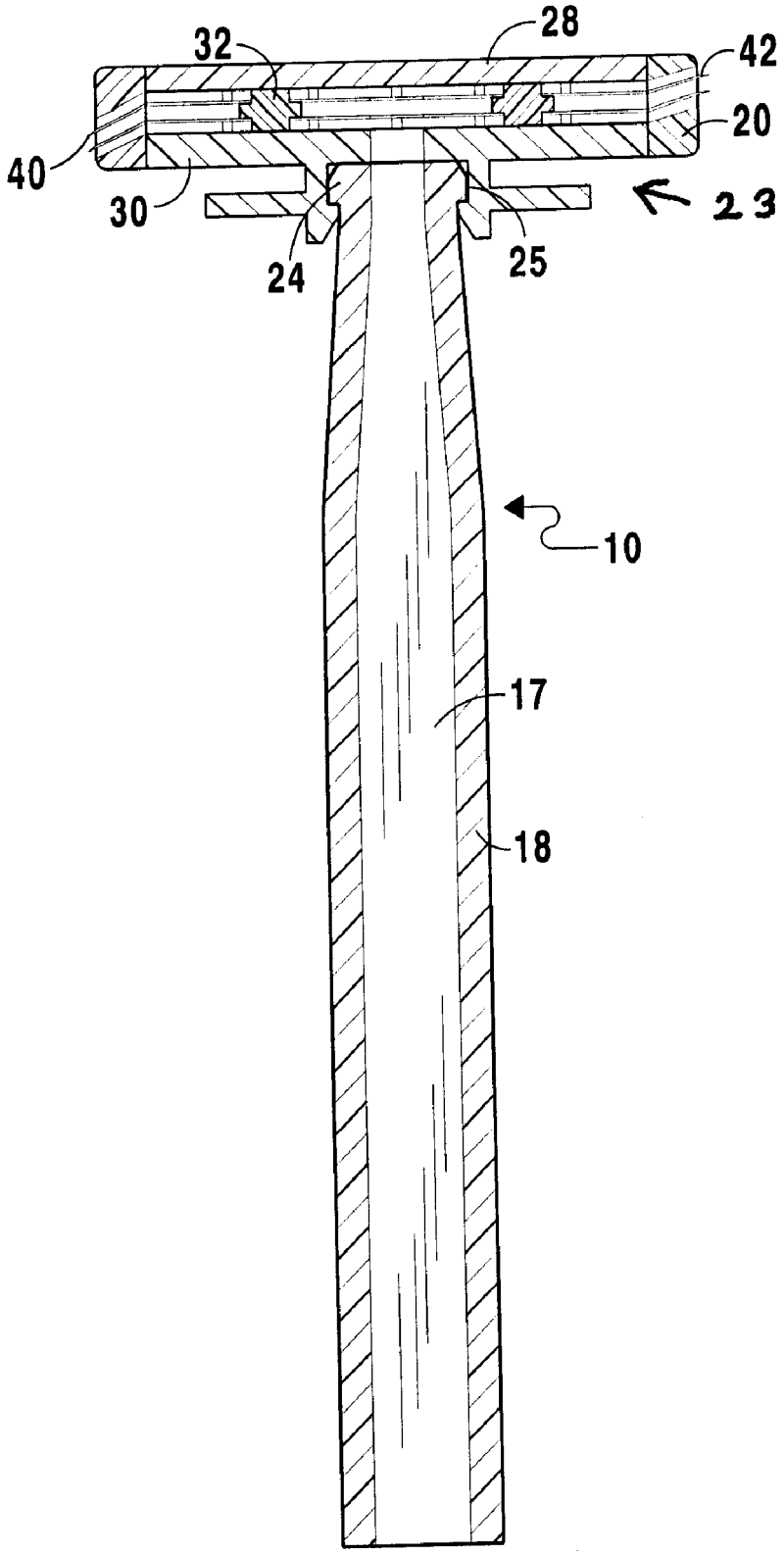
FIG. 3 is a cross sectional view of the preferred embodiment of the present invention, taken from FIG. 2 as indicated, showing the channel within the handle and the means for connecting the handle to the disposable and replaceable shaving head.

Turning to FIG. 3, therein is shown a cross sectional view of the preferred embodiment of the present invention 10 taken from FIG. 2 as indicated, showing the conduit 17 within the handle 18 and the means 23 for connecting the handle 18 to the disposable and replaceable shaving head 20. As can be seen the means 23 for connecting the handle 18 to the shaving head 20 comprises an enlarged means 24 on the end of the handle 18 which fits into a slot or groove 25 located on the underside of the shaving head 20 somewhat similar to a tongue in groove connection. Shown are upper 28 and lower 30 housing members with a mating central blade spacer 32. Also shown are significantly smaller straight edge blade extensions 40 on one end and convex short blade extensions 42 on the opposing end.

Figure 4:
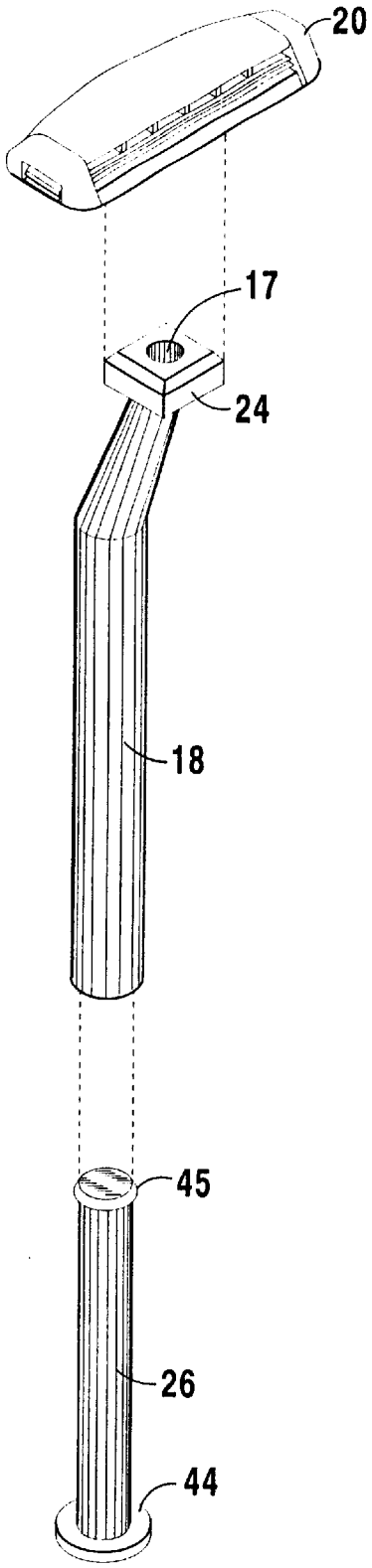
FIG. 4 is an exploded view of the major components of the preferred embodiment of the present invention. Shown is a plunger which can be used to inject fluids and creams through the head of the razor. Also shown is the handle having means for securing the handle to the shaving head. Also shown, is the shaving head.

Turning to FIG. 4, therein is shown an exploded view of the major components of the preferred embodiment of the present invention 10. Shown is a plunger 26 which can be used to inject fluids and creams placed into the conduit 17 through the head 20 of the razor 10. The plunger 26 has an enlarged head 44 on which to push it into the handle 18 which also serves as a stop to prevent the plunger 26 from being pushed too far into the handle 18. A smaller enlarged end 45 acts as a seal to hold the plunger 26 tightly in contact with the handle 18 interior. Also shown is the handle 18 having means 23 for securing the handle 18 to the shaving head 20. As can be seen the means 23 for connecting the handle 18 to the shaving head 20 comprises an enlarged end on the end 24 of the handle 18 which fits into a slot or groove 25 located on the underside of the shaving head 20 somewhat similar to a tongue in groove connection. Also shown is the opening from the conduit 17 in the handle 18.

Figure 5:
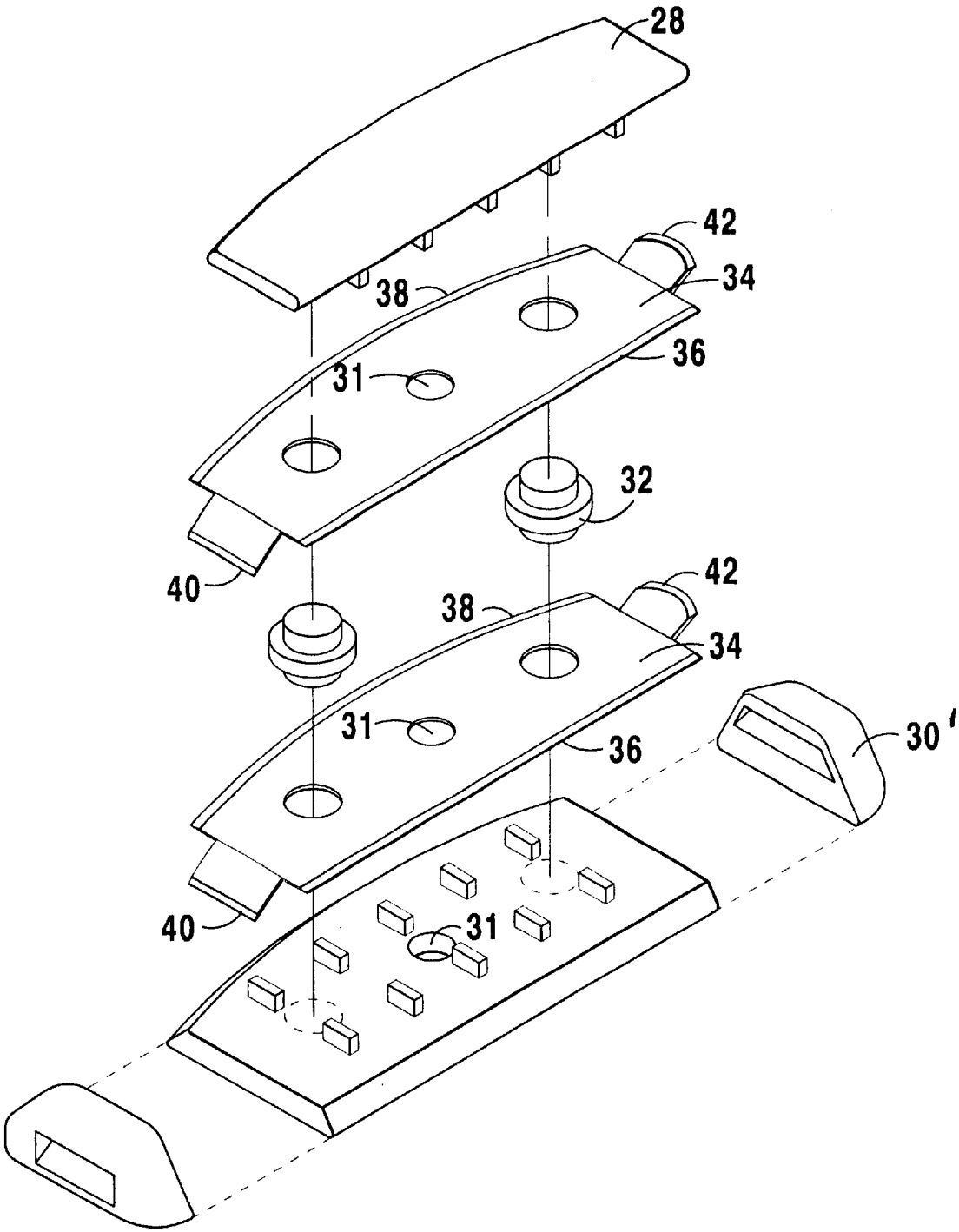
FIG. 5 is an exploded view of the components of the shaving head of the preferred embodiment. Shown are upper and lower housing members with a mating central blade spacer. Also shown are two blades having a straight edge on one long side and a convex blade edge on the oppositely opposed side and a significantly smaller straight edge on one short sides and a convex short blade located on the other short side.

Turning to FIG. 5, therein is shown an exploded view of the components of the shaving head 20 of the preferred embodiment 10. Shown are upper 28 and lower 30 housing members with mating dual central blade spacers 32. Also shown are two blades 34 having a straight edge 36 on one side and a convex edge 38 on the opposing side. Also shown are significantly shorter and smaller straight edge blade extensions 40 on one end and convex edge blade extensions 42 on the opposing end of the shaving head 20. Conduit 31, 31' is provided for the passage of cleaning water around and through the razor head 20.

Figure 6:
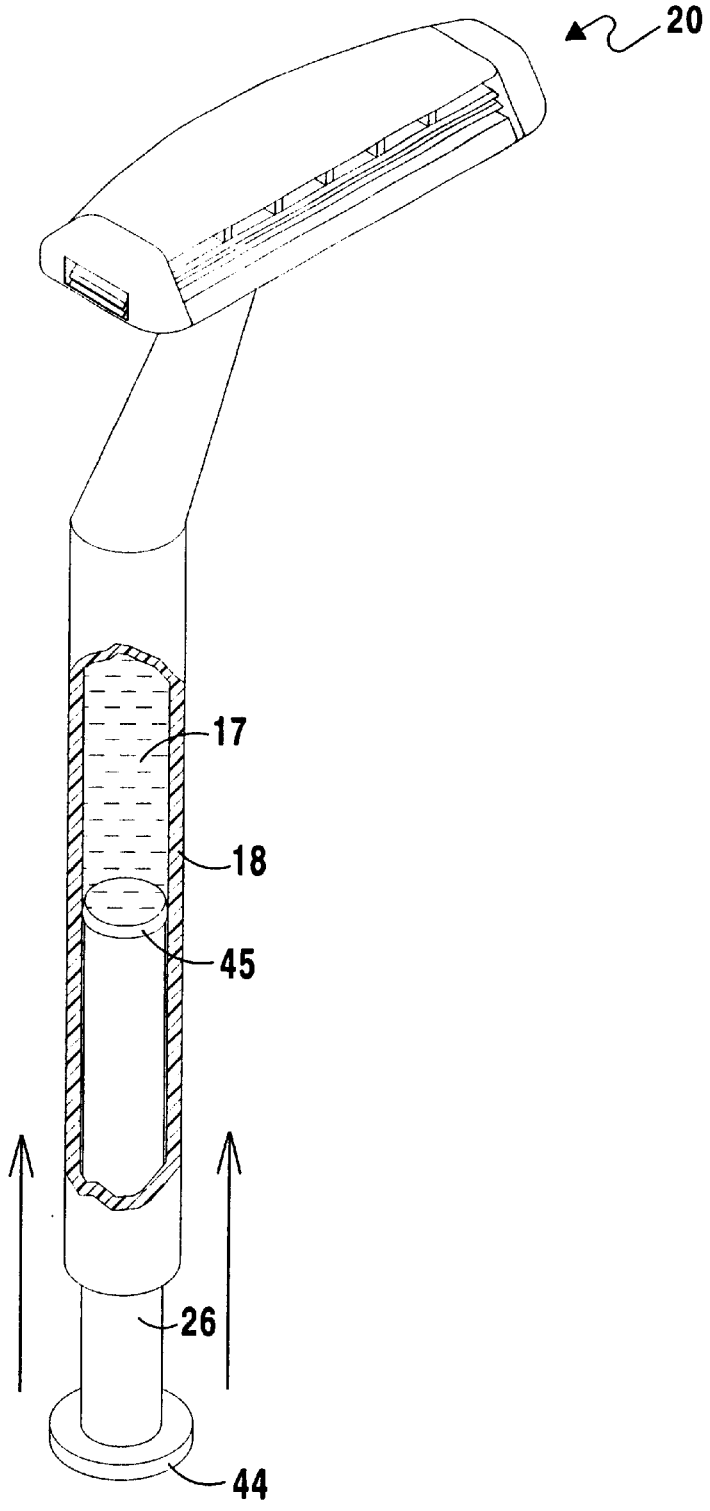
FIG. 6 is a sectional view of the hollow handle wherein by use of the plunger an amount of liquid or cream can be stored and selectively dispensed while shaving.

Turning to FIG. 6, therein is shown a sectional view of the hollow handle 18 wherein by use of the plunger 26 an amount of liquid or cream can be stored and collectively dispensed while shaving. Note that the liquid or cream is stored in the conduit 17 of the handle 18. Also shown therein is the head 20 of the razor. Note that the plunger 26 has an enlarged head 44 located so that it will serve as a stop for contacting the end of the handle 18 and also a seal 45.

Figure 7:
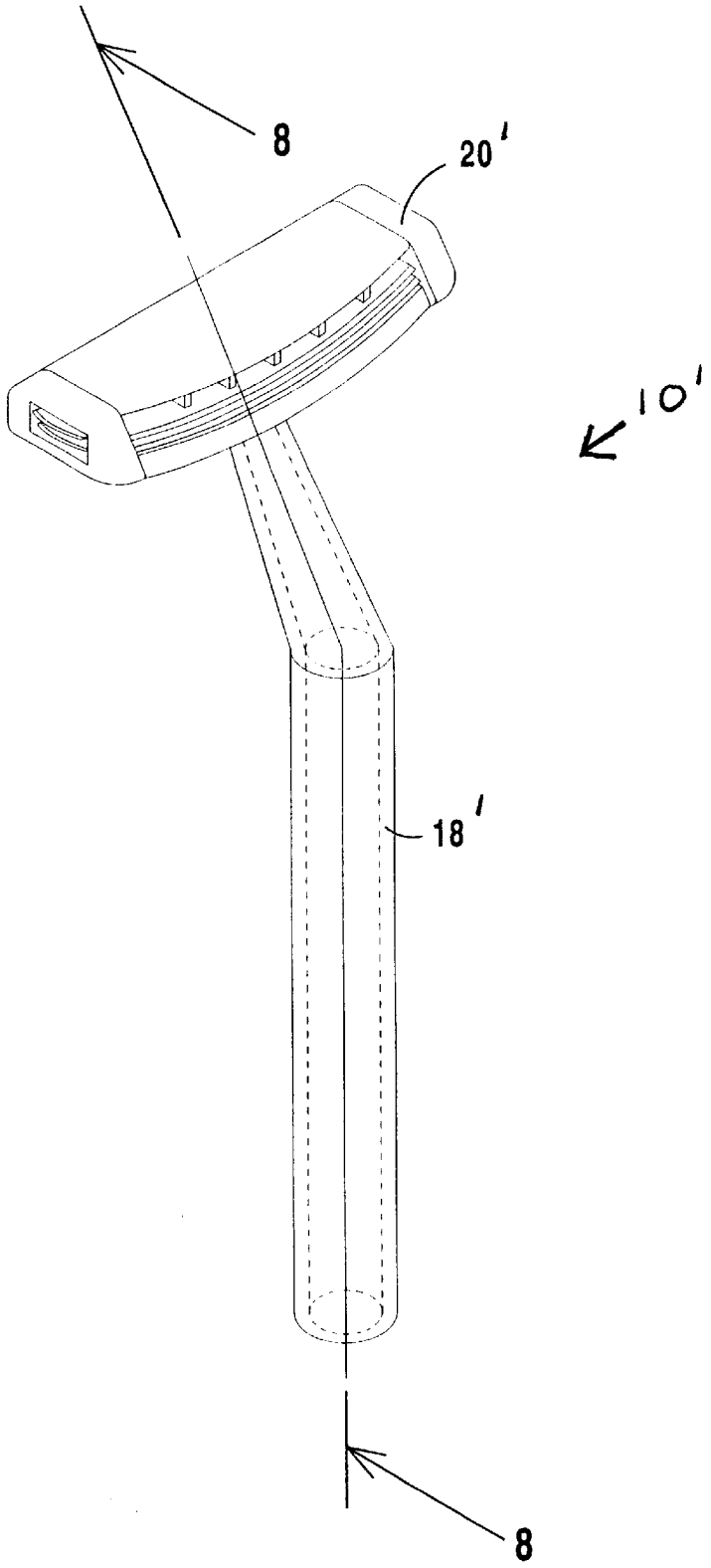
FIG. 7 is a perspective view of an additional disposable embodiment of the present invention.

Turning to FIG. 7, therein is shown a perspective view of an additional disposable embodiment of the present invention 10 where the handle 18' and head 20' are made as one piece. Shown therein is a disposable razor 10' with head 20' located at an angular distance from the body or handle 18' of the razor 10'. Other features of this embodiment are as previously described.

Figure 8:
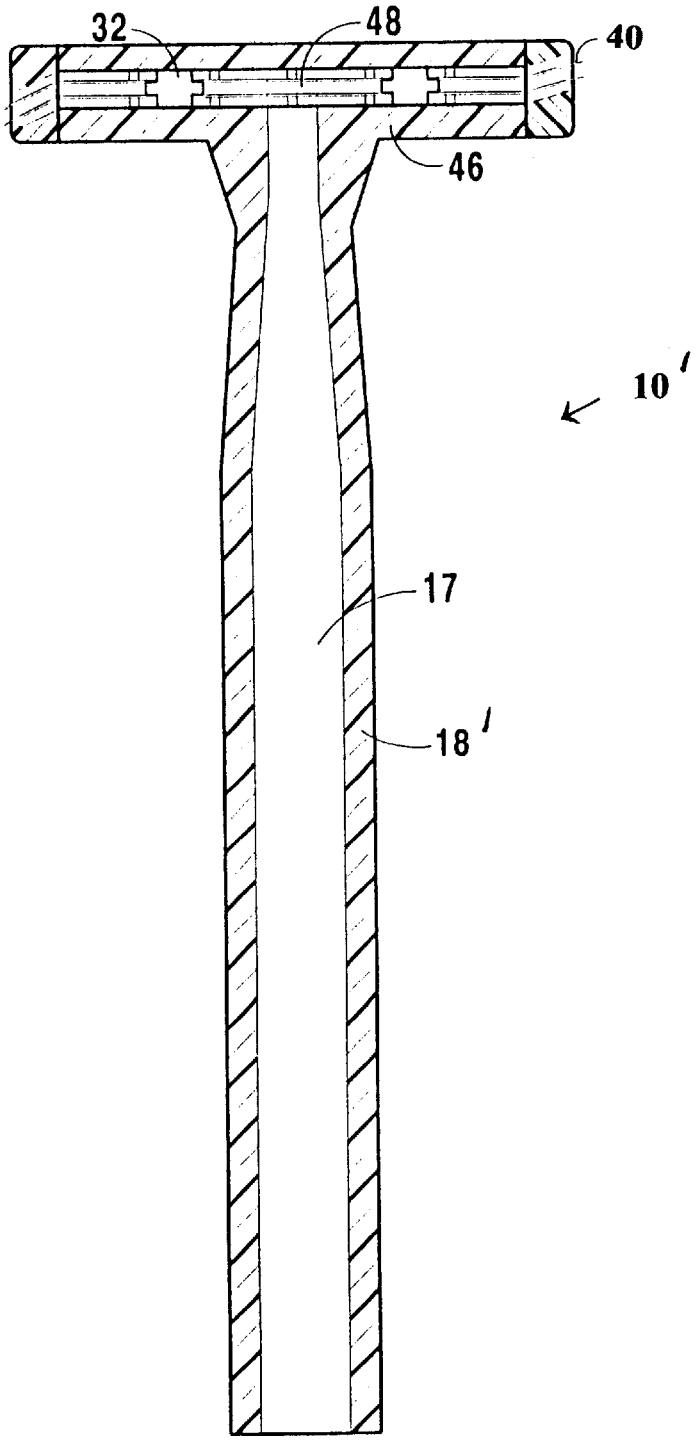
FIG. 8 is a cross sectional view of the additional embodiment of the present invention, taken from FIG. 7 as indicated, showing the one piece handle and the lower blade retaining member and the channel within the handle for cleaning purposes and for carrying oils, creams, and liquids to be dispensed through the blade cavity.

Turning to FIG. 8, therein is shown a cross sectional view of the additional embodiment of the present invention 10' taken from FIG. 7 as indicated. Shown is the handle 18' and the lower blade retaining member 46 and the channel 17 within the handle 18' for cleaning purposes or for carrying oils, creams or liquids to be dispensed through the blade cavity 48. It can be seen that liquid can travel through the conduit 17 and through the blade cavities 48 and out the edge of the blades 34. Also shown are the spacers 32.

Figure 9:
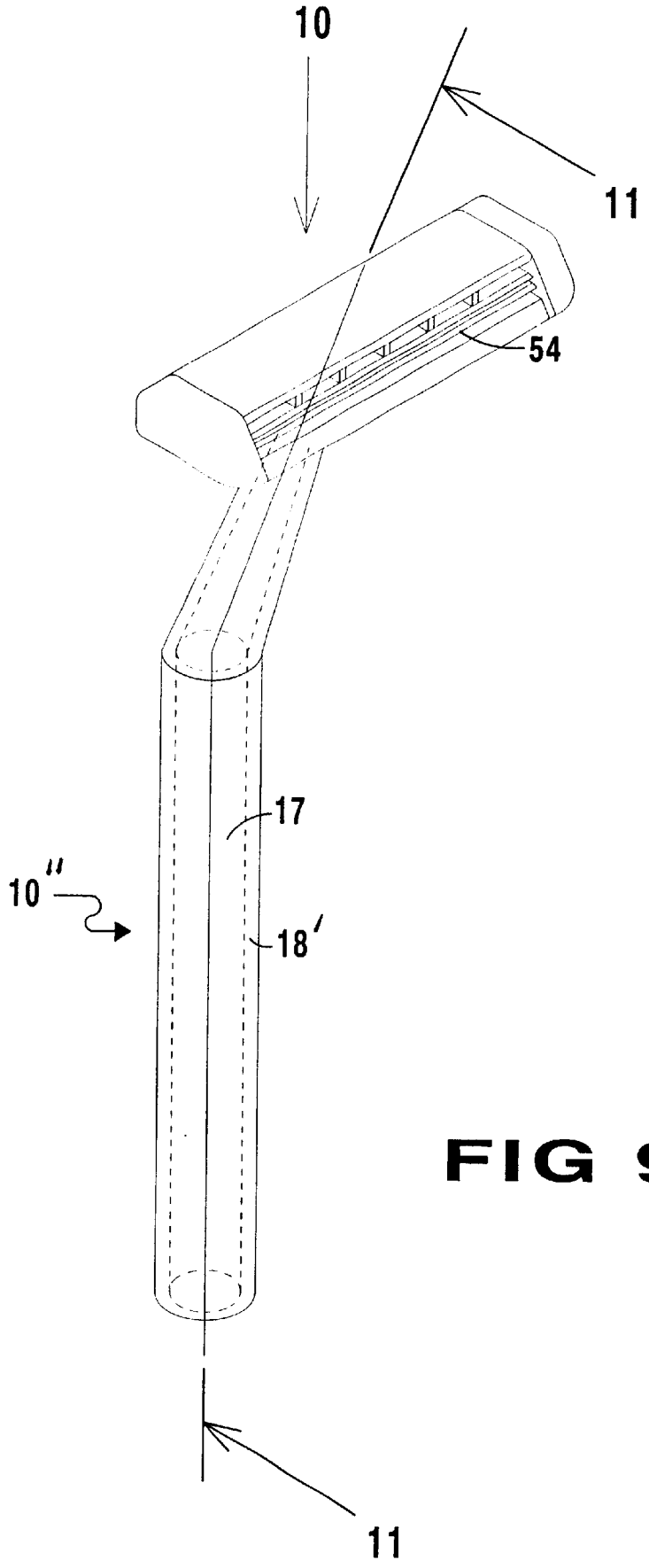
FIG. 9 is a perspective view of another additional embodiment of the present invention having dual blades with one shaving surface with a channel located down the center of the handle and opening into the blade cavity whereby water will travel from the opening in the end of the handle to the shaving head where it will dislodge shaving debris from around the blades of the safety razor. In addition oils, creams, and liquids can be carried within the handle cavity and dispensed while shaving.

Turning to FIG. 9, therein is shown a perspective view of another embodiment of the present invention 10" having dual blades 54 with only one shaving surface with the channel located down the center of the handle 18' and opening into the blade cavity whereby water can travel from the opening in the end of the handle 18' to the shaving head where it will dislodge shaving debris from around the blades 54 of the safety razor 10". In addition, oils, creams and liquids can be carried within the handle cavity 17 and dispensed while shaving. This embodiment is otherwise the same as previously described.

Figure 10:
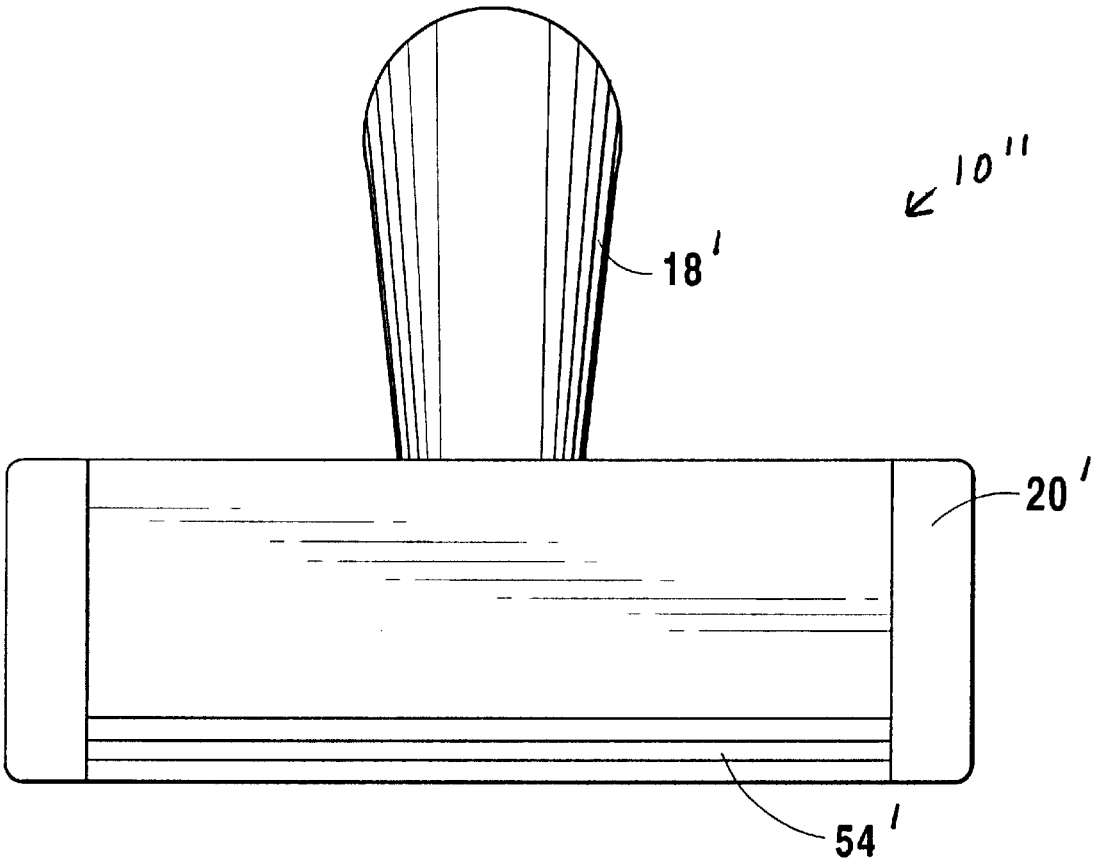
FIG. 10 is a top view of the additional embodiment, taken from FIG. 9 as indicated, showing the single dual bladed shaving surface.

Turning to FIG. 10, therein is shown a top view of the additional embodiment of the present invention 10" taken from FIG. 9 as indicated showing the single, dual-bladed shaving surface 54'. Also shown therein is the handle 18' and the head 20'.

Figure 11:
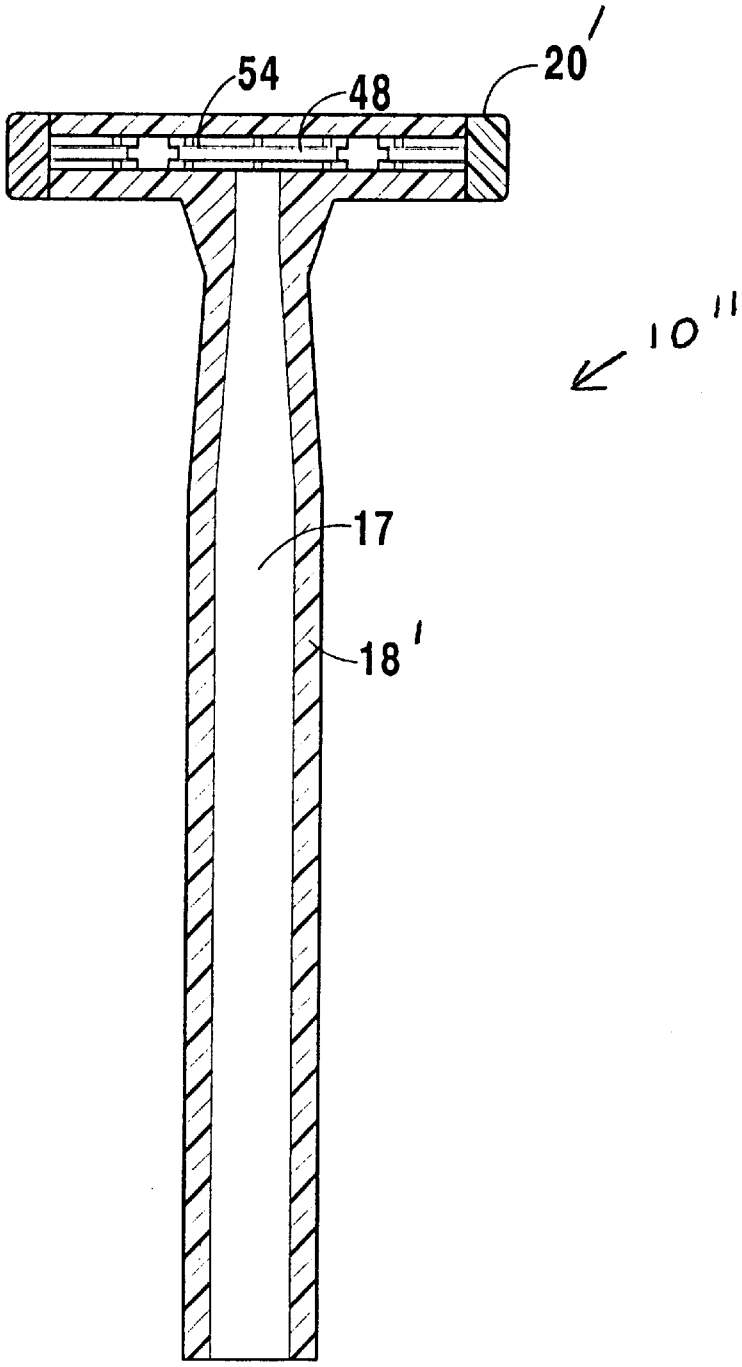
FIG. 11 is a cross sectional view of the additional embodiment of the present invention, taken from FIG. 9 as indicated, showing the dual blades with one shaving surface with a channel located down the center of the handle and opening into the blade cavity whereby water will travel from the opening in the end of the handle to the shaving head where it will dislodge shaving debris from around the blade surfaces.

Turning to FIG. 11, therein is shown a cross sectional view of the additional embodiment of the present invention 10" taken from FIG. 9 as indicated, showing the dual blades 54 with one shaving surface with a channel 17 located in the center of the handle 18' and opening into the blade cavity 48 whereby water will travel from the opening in the end of the handle to the shaving head 20' where it will dislodge shaving debris from around the blade 54 surfaces.

What is claimed is new and desired to be protected by Letters Patent is set forth in the claims:

1. An apparatus for shaving, comprising:

a) a plurality of blades and a generally rectangular shaped head with a pair of long sides joined by short sides, said head incorporating means to support said blades in a spaced relationship and having blade openings on four sides, each of said blades having cutting edges extending out of all of said blade openings with edges exposed for cutting from all four sides of said head, one of the short sides of said head having one of said blade openings which is an upwardly extending opening and the other of the short sides having another one of said blade openings which is a downwardly extending opening, wherein corresponding upward and downward extensions of each blade extend through said blade openings on the short sides, with cutting edges on free ends of said extensions;

(b) a handle having a proximal end connected to said head;

(c) said handle having a conduit therein extending from said proximal end to an open distal end;

(d) said head having a passageway communicating with said handle conduit;

(e) said blades having openings communicating with said passageway allowing cleansing water to circulate within said head between and through said blades and out through all four blade openings in said head so as to clean the apparatus; and (f) said head and handle being removably connected by a tongue and groove connection.

2. The apparatus of claim 1, wherein said handle has a plunger removably attached in said conduit whereby cream can be pushed through said handle.

3. The apparatus of claim 1, wherein at least one of said cutting edges is straight.

4. The apparatus of claim 1, wherein at least one of said cutting edges is convex.

5. The apparatus of claim 1, wherein at least one of said cutting edges is straight and at least one of said cutting edges is convex.

* * * * *